US005815854A

United States Patent [19]

Amaral et al.

[11] Patent Number: 5,815,854

[45] **Date of Patent: *Oct. 6, 1998**

[54] SECTIONAL PORTABLE HOT TUB

[76] Inventors: Joseph M. Amaral, c/o Welby Law Offices, Ten Welby Rd., New Bedford, Mass. 02745; Sylvester Amaral, III, 11 Cove Ave., Berkley, Mass. 02779; Timothy Amaral, 201 New St., Rehoboth, Mass. 02769

[ * ] Notice: This patent issued on a continued prosecution application filed under 37 CFR 1.53(d), and is subject to the twenty year patent term provisions of 35 U.S.C. 154(a)(2).

[21] Appl. No.: 783,789

[22] Filed: Jan. 15, 1997

Related U.S. Application Data

[63] Continuation of Ser. No. 406,541, Mar. 20, 1995, abandoned.

[51] Int. Cl.[6] ..... E04H 4/00

[52] U.S. Cl. ..... 4/506; 4/541.4

[58] Field of Search ..... 4/541.1–541.5, 4/506, 584, 585

[56] References Cited

U.S. PATENT DOCUMENTS

| | | | |
|---|---|---|---|
| 4,019,210 | 4/1977 | Patterson et al. | 4/492 |
| 4,149,281 | 4/1979 | Bob et al. | 4/541.4 X |
| 4,893,362 | 1/1990 | Murphy | 4/585 |
| 4,932,558 | 6/1990 | Katavolos | 4/506 X |
| 5,161,264 | 11/1992 | Dugas | 4/506 |
| 5,398,351 | 3/1995 | Watson | 4/506 |
| 5,408,707 | 4/1995 | Wilson | 4/541.1 X |
| 5,416,932 | 5/1995 | Ventrice | 4/506 X |
| 5,548,852 | 8/1996 | Rowe | 4/541.4 X |

*Primary Examiner*—Charles E. Phillips
*Attorney, Agent, or Firm*—Staas & Halsey

[57] ABSTRACT

A spa pool containing water within which humans can sit comfortably, which is portable, and which can be assembled and disassembled and stored sectionally. The water is recirculated through a externally connected pump and filtered heat system with a separately connected air induction pipe. Through this pipe air is forced through the water circulating within the contained and the water within the walls of the container.

6 Claims, 4 Drawing Sheets

SECTIONAL PORTABLE HOT TUB

This application is a continuation of application Ser. No. 08/406,541, filed Mar. 20, 1995, now abandoned.

BACKGROUND—FIELD OF INVENTION

This invention relates to pools containing water which is recirculated through a pump and filtered heating system, allowing the water to maintain a certain temperature and at the same time be aerated. These pools are more popularly referred to as "jacuzzis" or "hot tubs."

BACKGROUND—DESCRIPTION OF PRIOR ART

For a number of years pools containing heated water which was recirculated through a pump and filtered heating system have been offered to the consumer as a quasi-therapeutic device to relieve muscle tension. Early models which featured non-filtered water were then and are still referred to as "whirlpool baths." Users would sit on a stone or wooden bench which was situated below water level so that they could rest while the water circulated around them. This "jacuzzi" or "hot tub" was first presented in group establishments such as health spas, but has been adapted to widespread home use over the past decade.

Examples of prior art of this type include U.S. Pat. No. 4,466,141 to Starkey (1984) which depicts a hydrothermal "hot tub" or spa pool which provides for an improvement over previous designs by permitting users to rest in a reclining position. However, this design as well as others before it require a permanent attached structure.

Increased home use of "hot tubs" or spa pools spawned a fledgling "hot tub" rental industry with the development of the first portable "hot tub" by Popovich, et al in U.S. Pat. No. 4,858,254 (1989). Popovich was the first to indicate a design for a portable "hot tub" or spa pool which is not permanently attached and may be moved from place to place, but this could not be accomplished without much difficulty as the Popovich spa pool cannot be assembled and disassembled, but must be carried or rolled and must be stored as a single unit. U.S. Pat. No. 5,161,264 to Dugas (1992) showed the improvement of having a continuous outer wall without the inherent discomfort to the user of rigid vertical posts around the inner perimeter of a swimming pool. Though this added to the comfort of a swimming pool from the user's standpoint it did little to improve the status of portable "hot tubs" as Popovich's design has already incorporated the idea of a smoother wall. The U.S. Pat. No. 5,239,710 to Swinburn (1993) was a major advance in the comfort of spa pools as it provided for a cushioned seat and wall, however, as with the Popovich design, the Swinburn spa pool is intended to be a permanently built structure though it could initially be transported sectionally. Clark's U.S. Pat. No. 5,267,359 (1993) provided the additional improvement of a separately connected air induction pipe but did nothing otherwise to improve the portability of "hot tubs" for home use.

What is needed is a portable "hot tub" or spa pool which retains the features of comfort and a separately connected air-induction pipe, but which also can be assembled and reassembled repeatedly and with such ease that a single individual can do so without the aid of tools, and which can be stored sectionally to permit easy off-season storage.

DESCRIPTION OF THE PREFERRED EMBODIMENT

Referring to FIGS. 1 through 5, the perimeter wall of the invention is generally indicated at 10 and the perimeter skirt indicated at 11. The piping which is placed upon the perimeter skirt is generally indicated at 12. The suction portion of the piping through which water is drained from the invention is shown at 13 and the holes within it through which the water is removed at 14. Piping containing heated water which is pumped into the invention is indicated at 15 with the pump and filtered heating system 17 also being shown. The hydrotherapy jet inlets through which this heated water is introduced into the invention are shown at 18. Piping through which air is forced into the invention is demonstrated at 19 and the holes through which the air is forced into the water in the invention are shown at 20.

Figure 1:
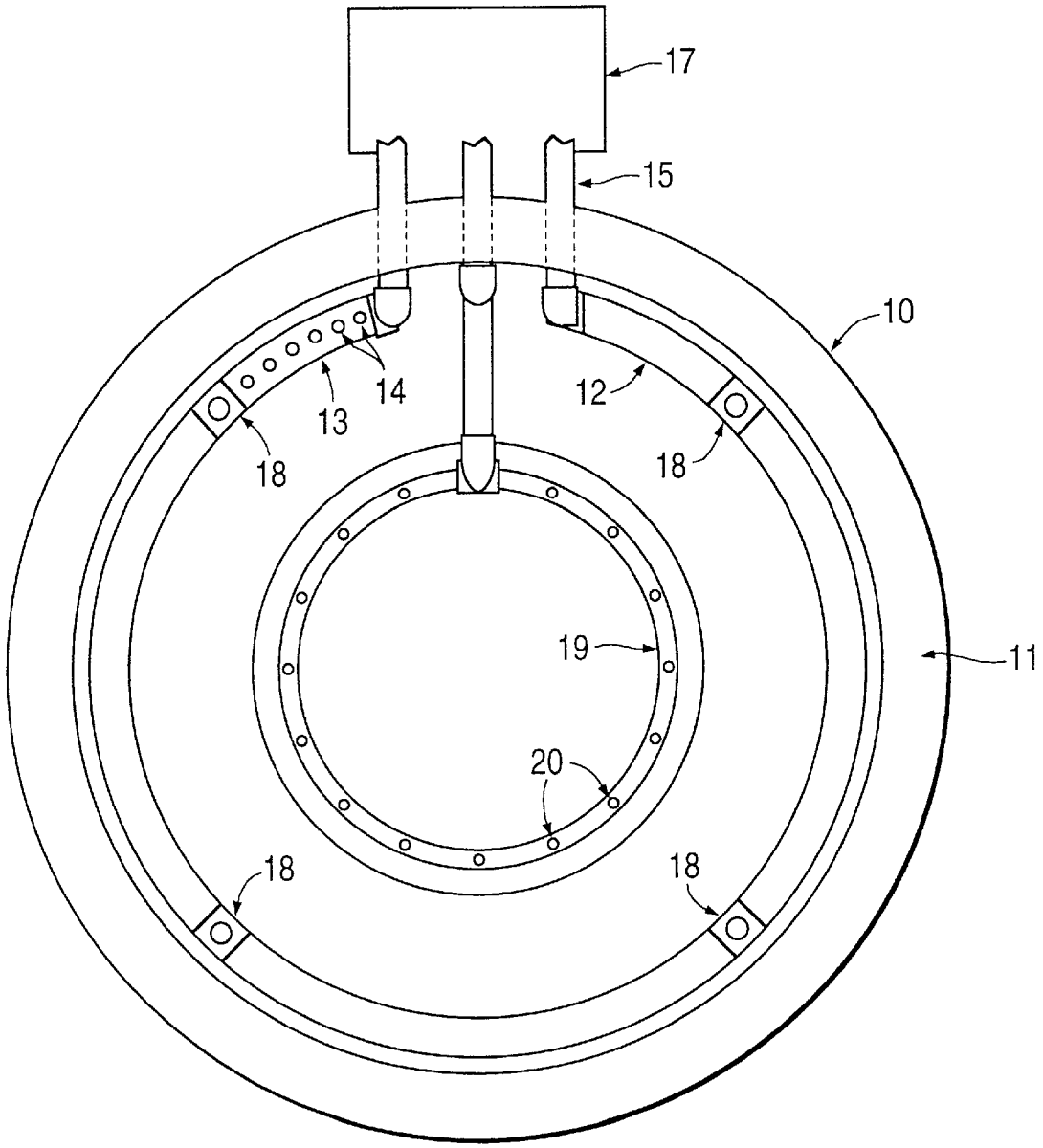
FIG. 1 depicts an overhead view of the present invention illustrating the placement of piping upon the perimeter skirt in a circular version of the invention.
Figure 2:
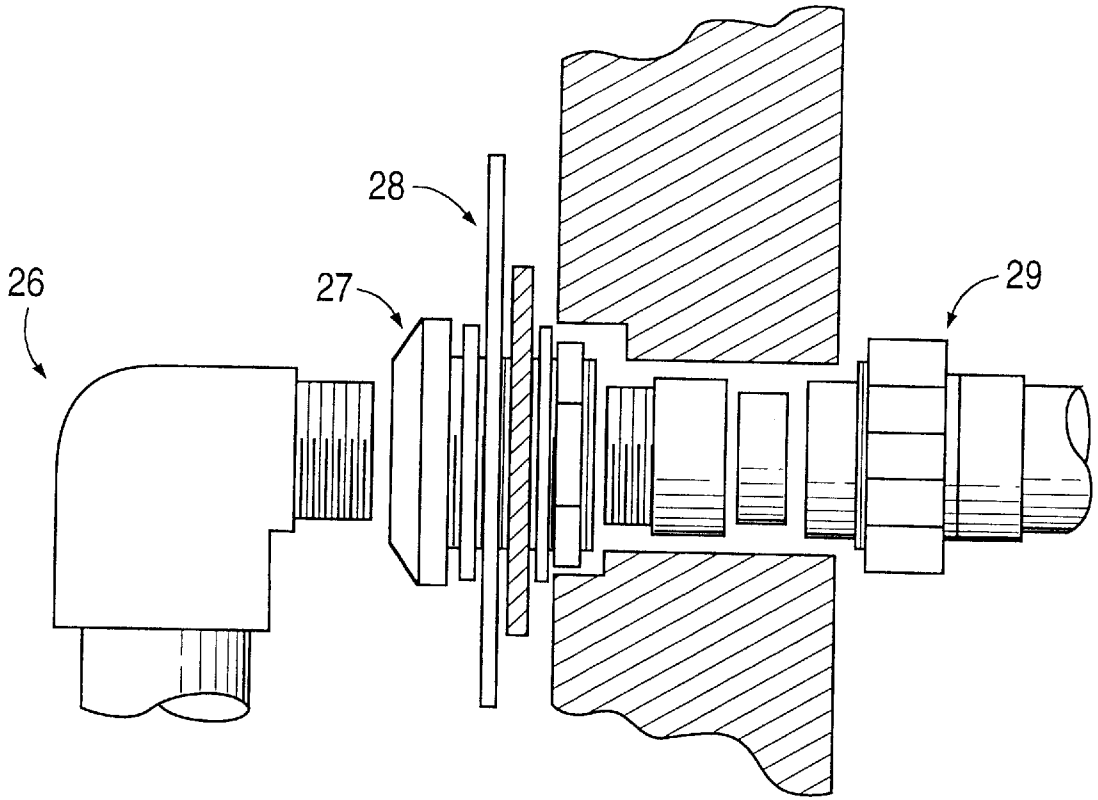
FIG. 2 shows the method of connection of the outer piping to the inner piping of the invention through the wall of the invention.
Figure 3:
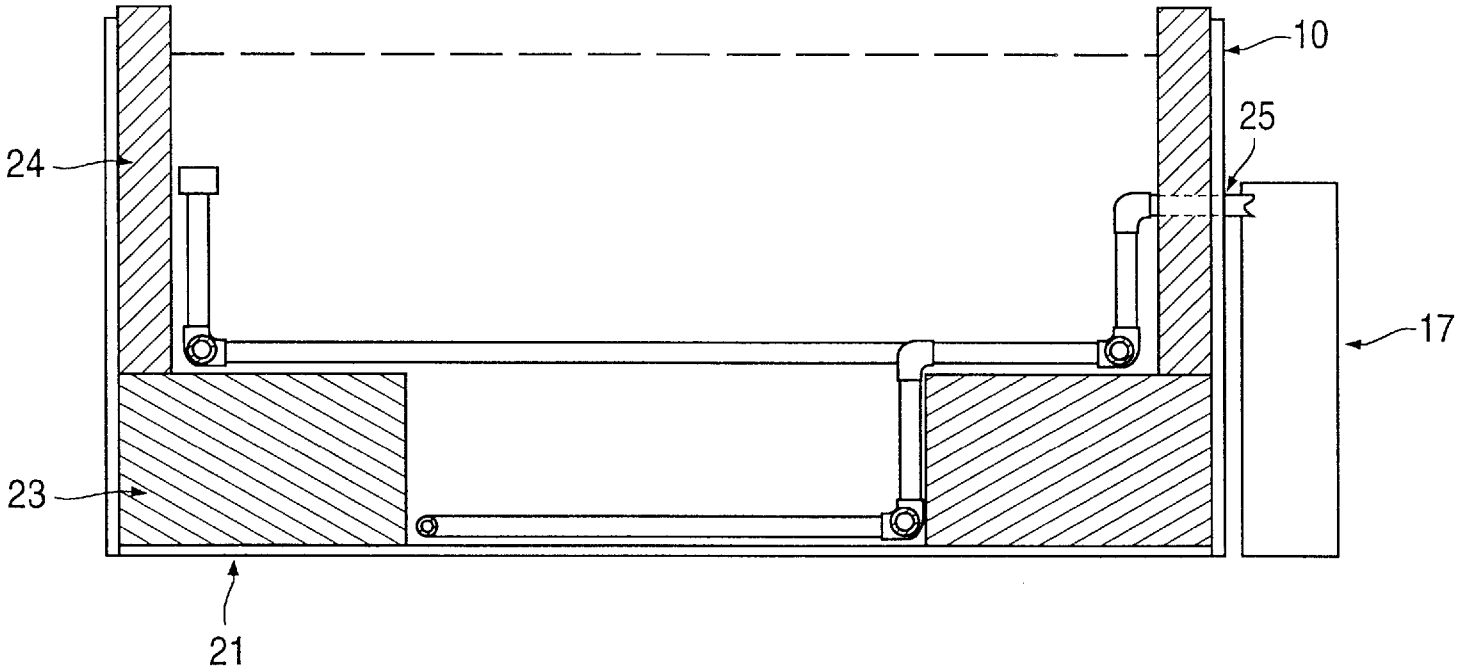
FIG. 3 illustrates a cross section of the present invention and its connection to the external pump and filtered heating system.
Figure 4:
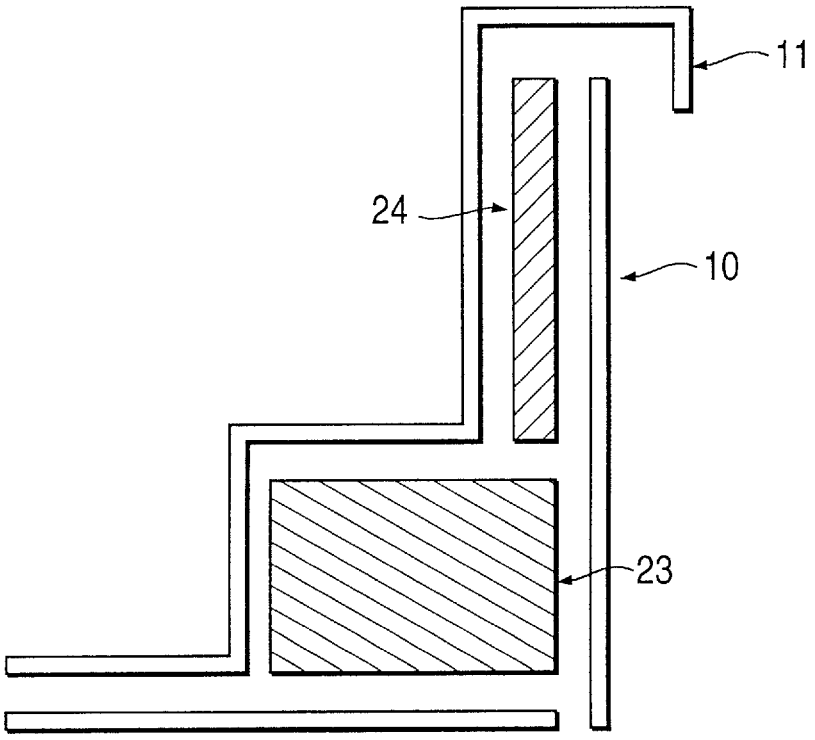
FIG. 4 shows a breakdown of the components of a cross section of a wall, seat, and base of the present invention.
Figure 5:
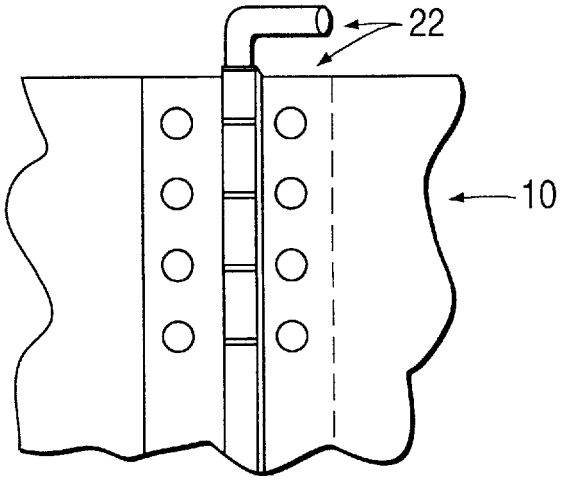
FIG. 5 shows the method of securing the perimeter skirt to enclose the perimeter of the present invention.

The invention is characterized by its ease of assembly and disassembly which can best be demonstrated through a description of the method. The invention is assembled first by placing a foam base of any shape on the ground or floor 21. The perimeter wall 10 whether it be in one or multiple sections is then placed at a right angle against the aforementioned base around the entire perimeter of said base. As is clearly shown in FIG. 5, first and second connection pieces (which are shown, for example, as being hinge parts having a receiving hole therethrough) are provided at ends of the perimeter wall 10. The connection pieces are then connected together to the base with one or more locking hinges 22. As shown in FIG. 5, a connection pin extends through the receiving holes of the hinge parts. The perimeter wall is constructed of a flexible material or plastic material which will not permit the escape of water but will also be rigid enough to make it difficult to bend when leaned upon. Foam bench sections 23 are then placed on the base against the perimeter wall. Foam wall sections 24 are then placed against the inner portion of the perimeter wall and the top of the base. Referring to FIG. 3, it is easy to see that wall sections 24 are on top of bench sections 23 to define an area of bench sections 23 toward the hole in the ring structure, which is uncovered by the wall sections 24. Wall sections and bench sections are made of styrofoam or any commercially available styrofoam-like material and may number from one to ten. The perimeter skirt 11 is then draped over the perimeter wall, foam wall sections, and base. The perimeter skirt is constructed of a flexible and waterproof material such that it can be draped over the perimeter wall and base, extending over the outer portion of the perimeter wall. The piping 12, 13, 15 is then placed upon the perimeter skirt and connected through the skirt and corresponding holes in the perimeter wall 25 to the pump and filtered heating system 17 through the use of a male elbow 26, gasket 27, male adapter 28, and union 29 as shown in FIGS. 2 and 3. That is, the elements 27, 28 and 29 and associated elements which are shown in FIG. 2 as extending through the perimeter wall permit connection of piping 12, 13, 15 to exterior equipment such as pump 16 and filtered heating system 17. The invention is disassembled by reversing the above procedure.

The method of operation of the sectional portable hot tub is identical to that for "hot tubs" in present use with the exception of the methods of assembly and disassembly as shown above.

SUMMARY, RAMIFICATIONS AND SCOPE

Accordingly, the reader will see that the sectional portable "hot tub" of this invention can be used as existing "hot tubs" are used with the important added features of:

(a) a shell which can be assembled or disassembled sectionally and thereby conveniently transported;

(b) a shell which can be assembled or disassembled sectionally and thereby provide a maximum convenience to the consumer in its use;

(c) a shell which can be assembled or disassembled sectionally and provide ease of storage (particularly off-season);

(d) providing a "hot tub" with an external support system which is adaptable to a variation of equipment packs or support systems and can allow for a variation of heating times from two to ten hours;

(e) a separate air induction line(s) allowing for maximum aeration through an external blower and not relying on water circulation for a massaging effect;

(f) providing a "hot tub" with an external support system which allows the user to be in a comfortable seated position inside and have the water level above his or her shoulders;

(g) through-the-wall, quick-disconnect plumbing connections for suction, discharge and aeration which allow for maximum portability, ease of assembly/disassembly and ease of storage (particularly off-season storage).

While a particular embodiment of the invention is shown, it will be understood by those skilled in the art that changes and modifications may be made thereto without departing from the invention in its broader aspects and as set forth in the following claims:

We claim:

1. A portable, readily assembled and disassembled spa pool for the containment of water, comprising:

a base having a perimeter;

a flexible one-piece removable perimeter sheet having first and second ends and a length between the first and second ends, the first and second ends fitting together for releasable connection, the perimeter sheet forming a perimeter wall when connected, the perimeter wall having an inner and an outer surface and upper and lower edges, the lower edge being removably placed with said inner surface abutting the perimeter of the base such that the perimeter wall is at a right angle to said base;

a plurality of removable rigid seat sections which are individually placed on top of said base along said inner surface of said perimeter wall to make contact with the perimeter wall and define an exposed center area of said base surrounded by said seat sections;

a plurality of removable interior wall sections which are individually placed on top of said seat sections against said inner surface of said perimeter wall to define an exposed area of the seat sections uncovered by the interior wall sections;

a removable, waterproof, flexible liner draped over the exposed center area of the base, the exposed area of the seat sections, the interior wall sections, and the upper edge of the perimeter wall; and removable piping for conduction of forced air into the spa pool and heated water into and out of the spa pool, said piping placed on top of the liner.

2. The spa pool as set forth in claim 1, wherein the perimeter of the base is round and the perimeter wall is cylindrical when the first and second ends are connected.

3. The spa pool as set forth in claim 1, wherein the base has a width, and the width of the base and the distance from the upper edge to the lower edge of the perimeter wall are sufficient to hold human beings.

4. The portable spa as set forth in claim 1, wherein the perimeter sheet has a hole extending therethrough, a connection mechanism being located in the hole for connecting the removable piping to exterior equipment.

5. The portable spa as set forth in claim 1, further comprising first and second hinge parts provided respectively at the first and second ends of the perimeter sheet, each having a receiving hole extending therethrough, the hinge parts being releasably connected by a connection pin extending through the receiving holes of both hinge parts.

6. The spa pool as set forth in claim 1, wherein the seat sections are formed of styrofoam.

* * * * *

UNITED STATES PATENT AND TRADEMARK OFFICE

CERTIFICATE OF CORRECTION

PATENT NO.: 5,815,854
DATED : October 6, 1998
INVENTOR(S): Joseph M. AMARAL et al.

It is certified that error appears in the above-identified patent and that said Letters Patent is hereby corrected as shown below:

On the title page, item [63], after "abandoned", insert --, which is continuation of Serial No. 08/217,096, filed March 23, 1994, now abandoned.--

Signed and Sealed this

Twenty-eighth Day of September, 1999

*Attest:*

Q. TODD DICKINSON

*Attesting Officer*

*Acting Commissioner of Patents and Trademarks*